US007021951B2

(12) United States Patent
Tronolone et al.

(10) Patent No.: US 7,021,951 B2
(45) Date of Patent: Apr. 4, 2006

(54) SELF-NORMALLING JACK WITH MAGNETICALLY CONTROLLED NORMAL CIRCUIT OR RELAY

(76) Inventors: James Tronolone, 56 Cedar Rd., Ringwood, NJ (US) 07456; Virginia Tronolone, 56 Cedar Rd., Ringwood, NJ (US) 07456

( * ) Notice: Subject to any disclaimer, the term of this patent is extended or adjusted under 35 U.S.C. 154(b) by 512 days.

(21) Appl. No.: 10/210,900

(22) Filed: Aug. 5, 2002

(65) Prior Publication Data

US 2004/0021372 A1 Feb. 5, 2004

(51) Int. Cl.
*H01R 29/00* (2006.01)

(52) U.S. Cl. ..... 439/188; 200/51.1

(58) Field of Classification Search ..... 439/49, 439/188; 200/51.04, 51.05, 51.09, 51.1; 307/134

See application file for complete search history.

(56) References Cited

U.S. PATENT DOCUMENTS 3,020,365 A * 2/1962 Neenan ..... 200/51.09
3,117,193 A * 1/1964 Hirshfield et al. ..... 200/51.09
4,080,040 A * 3/1978 Lancaster ..... 439/43
4,616,285 A * 10/1986 Sackett ..... 361/1
4,647,120 A * 3/1987 Karabakakis ..... 439/39
5,280,254 A * 1/1994 Hunter et al. ..... 333/124
6,424,710 B1 * 7/2002 Bartolutti et al. ..... 379/326
6,528,746 B1 * 3/2003 DeWitt et al. ..... 200/51.09
6,707,172 B1 * 3/2004 Tronolone et al. ..... 307/134

* cited by examiner

*Primary Examiner*—Neil Abrams
(74) *Attorney, Agent, or Firm*—Clifford G. Frayne

(57) ABSTRACT

A self-normalling jack with a magnetically controlled normal circuit, switch or relay comprising a pair of receptacles having a sensing means for sensing the insertion of a plug, the sensing means in communication with an electronic normalling circuit, switch or relay, the electronic normalling circuit, switch or relay in communication with a paired receptacle such that the electronic normalling circuit, switch or relay is located between the source terminal and the source jack and between the destination jack and the destination terminal. The sensing means being the interruption or non-interruption of the magnetic field by the presence or absence of a patch cord in the jack respectively.

5 Claims, 1 Drawing Sheet

SELF-NORMALLING JACK WITH MAGNETICALLY CONTROLLED NORMAL CIRCUIT OR RELAY

BACKGROUND OF THE INVENTION

1. Field of the Invention

The present invention relates to jack receptacles which receive patch cords, and in particular, to an electronic-normalling circuit, electronic relay or switch, controlled electronically or magnetically by means of electronic sensors or permanent magnets that sense when a plug on the end of a patch cord is inserted into a jack receptacle which increases reliability and bandwidth capability.

2. Description of the Prior Art

A self-normalling jack internally routes a signal from one electronic device to another. Typically connectors are used with the rear source (input), and rear destination (output). On the front are standard patch ports. The internal normal path runs from the rear source to the rear destination. The signal can be rerouted by inserting a patch cord into either front port. Removal of the patch cord returns the signal to the normal path (i.e. "self-normalled").

The mechanical self-normalling jack suffers from the fact that continuous current flowing through it allows for contamination which can create a non-connection. It can also become contaminated by dust, dirt and developing a slight film which can cause a non-connection. Applicant's invention provides for a self-normalling jack with an electronically or magnetically controlled normal circuit or relay.

OBJECTS OF THE INVENTION

An object of the present invention is to provide for an electronic self-normalling jack, the function of which is electronically incorporated by means of an electronic circuit.

Another object of the present invention is to provide for a novel electronically self-normalling jack which provides greater band width capability.

Another object of the present invention is to provide for a novel electronically self-normalling jack which provides for greater reliability.

Another object of the present invention is to provide for a novel electronically self-normalling jack which is less susceptible to contamination and possible non-connection.

Another object of the present invention is to provide for a self-normalling jack the function of which is controlled electronically or magnetically and performed by an electronic circuit, an electronic relay, or a magnetically controlled switch.

Another object of the present invention is to provide for a self-normalling jack the function of which is performed without the means of a mechanically activated switch.

SUMMARY OF THE INVENTION

A self-normalling jack with an electronically controlled normal circuit, relay or magnetically controlled switch comprising a pair of receptacles having a sensing means for sensing the insertion of a plug, the sensing means in communication with an electronically controled normal circuit, relay or magnetically controlled switch, the electronically controlled normal circuit, relay or magnetically controlled switch in communication with a paired receptacle such that the electronic normalling switch or relay is located between the source terminal and the upper jack and between the lower jack and the destination terminal. The electronically controlled normal circuit, relay or magnetically controlled switch also connects the source to the destination when no patch cord is inserted into either the upper or lower jack receptacle. When the patch cord is inserted into the upper jack, the source signal is connected to the patch plug. When the patch cord is inserted into the lower jack, the destination signal is connected to the patch plug. Inserting a cord into either jack receptacle disconnects the source from the destination.

In the case of the magnetically controlled switch, the altering or blocking of the magnetic field by the insertion of a plug would activate the normalling switch.

BRIEF DESCRIPTION OF THE DRAWINGS

These and other objects of the present invention will become evident particularly when taken in light of the following illustrations wherein.

DETAILED DESCRIPTION OF THE DRAWINGS

Figure 1:
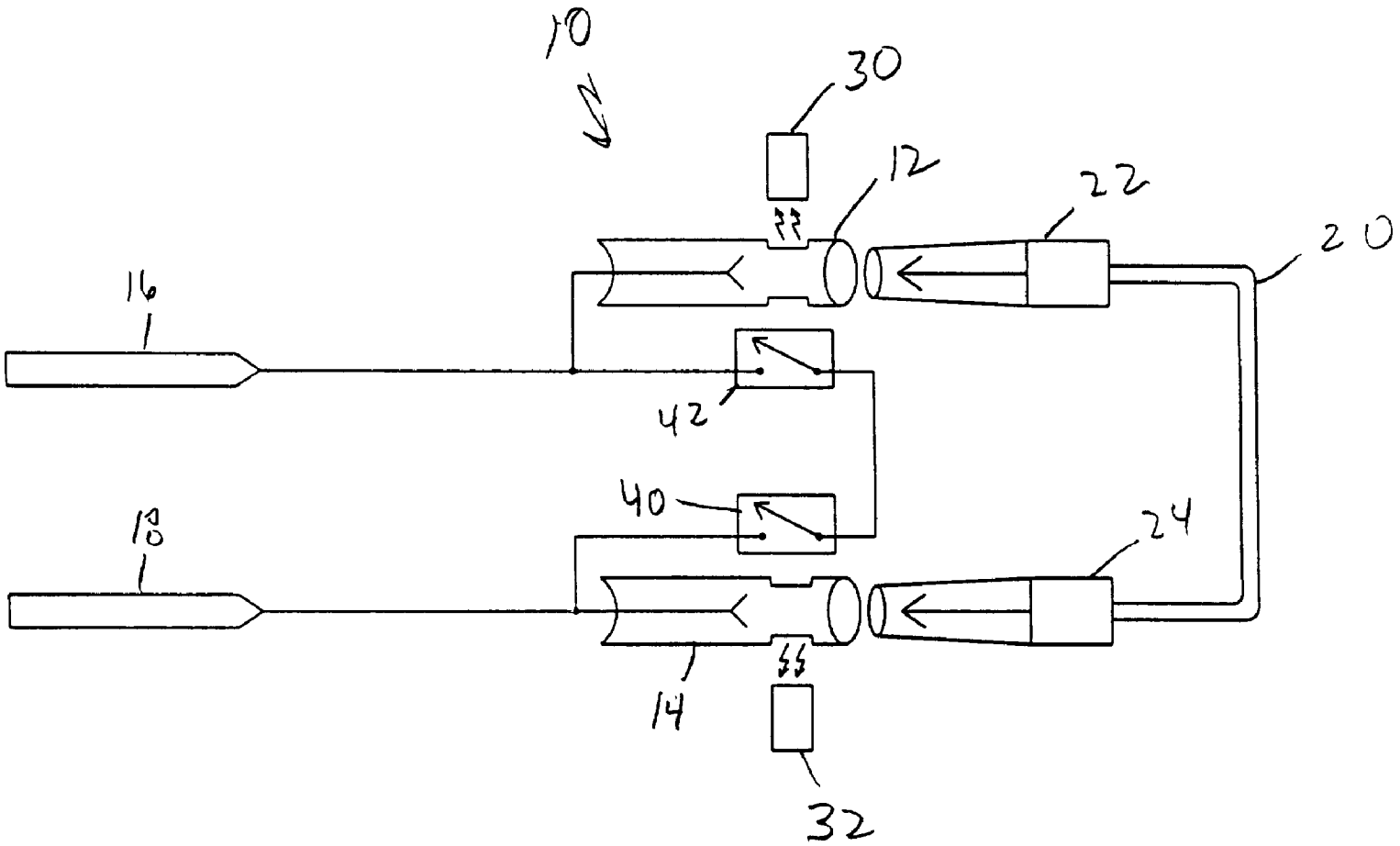
FIG. 1 is a schematic diagram of the electronic self-normalling jack controlled magnetically.

FIG. 1 is a schematic diagram of a magnetically controlled self-normalling jack of the present invention. A self-normalling jack would be utilized in any type of electrical appliance having jack receptacles and designed to direct or redirect any signals such as audio, video, digital, telephone, data, fiber, fiber optics, or the like.

The circuit 10 is in communication with a first jack receptacle 12 and a second jack receptacle 14. A source signal 16 is in communication with the circuit and the circuit is in communication with a destination signal 18 for the signal. In order to redirect the signal, a patch cord 20 with associated plugs 22 and 24 are inserted into the first and second jack receptacles 12 and 14. In the embodiment illustrated in FIG. 1, each jack receptacle 12 and 14 has associated therewith a magnet device 30 and 32. The magnets 30 and 32 are in communication with the electronic normalling switch or relays 40 and 42. The magnet would sense the presence or absence of a jack plug and electronically control the normalling switch or relay 40 or 42for either an open or closed orientation. In the case of the magnetically controlled switch, the normalling switch having a means of operating the magnetically controlled switch, the blocking of the magnetic field by the inserion of a plug would activate the normalling switch and still maintain no moving parts on the actuator.

A self-normalling jack internally routes a signal from one device to another. Typically BNC connectors are used with the rear source 16 and a rear destination 18. On the front are standard patch ports 12 and 14. The internal normal path runs from the rear source to the rear destination. The signal can be rerouted by inserting a patch cord into either front port 12 or 14. Removal of the patch cord returns the signal to the normal path (i.e. "self-normaled")

In FIG. 1 switches 40 and 42 are both closed when no patch cord 20, 22, or 24 is inserted into either jack 12 or 14. When the patch cord is inserted into jack 12, the source signal 16 is connected to plug 22 and available on plug 24 to be inserted into another jack for redirection of the signal. Simultaneously switch 42 is opened and the source signal 16 is no longer connected to the destination 18. Similarly if a plug is inserted into jack 14, switch 40 opens and disconnects the original source signal from the destination 18 and a new source signal is applied by inserting plug 22 into another source jack. The patch cord is only used to redirect the source and destination signals. The source signal 16 and the destination signal 18 are connected together, and self-normaled, when no patch cord is inserted. This is the definition of self-normalling.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

We claim:

1. A self-normalling jack having a magnetically controlled normal circuit or relay for redirecting an electronic signal from its source to its destination comprising:

a first jack receptacle in communication with a signal source;

a second jack receptacle in communication with a destination source;

a first normalling electronic circuit switch or relay in communication with said source signal, a second normalling electronic circuit switch or relay in communication with said destination signal, said second normalling electronic circuit switch or relay in communication with said first normalling electronic circuit switch or relay;

a first magnet having a magnetic field encompassing said first jack receptacle and in communication with said first normalling electronic circuit switch or relay;

a second magnet having a magnetic field encompassing said second jack receptacle and in communication with said second normalling electronic circuit switch or relay, said first magnet and said second magnet sensing the presence or absence of a patch cord plug positioned in said first jack receptacle or said second jack receptacle and signaling said electronic normalling switch, thereby respectively opening or closing said magnetically controlled normal circuit switch or relay for the redirection of said signal.

2. The self-normalling jack having a magnetically controlled normal circuit switch or relay in accordance with claim 1 wherein said sensing means comprises the interruption or non-interruption of said magnetic field.

3. A method of self-normalling a jack to increase reliability and bandwidth capability, said method comprising:

positioning a magnetically controlled normal circuit, switch or relay in communication with a source signal and a destination signal, said source signal and said destination signal being in communication with a first jack receptacle and a second jack receptacle;

positioning a first magnet having a magnetic field proximate said first jack receptacle, said magnetic field encompassing said first jack receptacle;

positioning a second magnet having a magnetic field proximate said second jack receptacle, said magnetic field encompassing said second jack receptacle, said first magnet and said second magnet in communication with said magnetically controlled normal circuit, switch or relay;

generating a control signal from said first magnet and said second magnet to said normal switch indicating the presence or absence of a patch cord plug in said first jack receptacle or said second jack receptacle;

opening or closing said magnetically controlled normal circuit, switch or relay responsive to said control signal signaling the presence or absence of a patch cord plug in said first jack receptacle or said second jack receptacle.

4. The method of self-normalling a jack in accordance with claim 3 wherein said signal is generated when said magnetic field is interrupted.

5. The method of self-normalling jack in accordance with claim 4 wherein said sensing means comprises a magnetic field which is altered by the insertion of the said patch cord plug.

* * * * *